United States Patent [19]

Greenberg

[11] Patent Number: 4,890,337

[45] Date of Patent: Jan. 2, 1990

[54] PANTS-LIKE GARMENT INCORPORATING A STRETCHABLE CONSTRUCTION

[75] Inventor: Bert Greenberg, 1201 S. Ocean Dr., Hollywood, Fla. 33019

[73] Assignees: Bert Greenberg; Jodee K. Greenberg, both of Hollywood, Fla.

[21] Appl. No.: 290,626

[22] Filed: Dec. 27, 1988

[51] Int. Cl.[4] ..... A41D 11/02

[52] U.S. Cl. ..... 2/236; 2/220; 2/221; 2/237

[58] Field of Search ..... 2/237, 220, 221, 236, 2/311, 317

[56] References Cited

U.S. PATENT DOCUMENTS

| | | | |
|---|---|---|---|
| 3,703,008 | 11/1972 | Hudson | 2/237 |
| 4,523,337 | 6/1985 | Leibowitz | 2/237 |
| 4,669,130 | 6/1987 | Brown | 2/227 |

FOREIGN PATENT DOCUMENTS

| | | | |
|---|---|---|---|
| 1456822 | 9/1966 | France | 2/221 |
| 2542583 | 9/1984 | France | 2/236 |

*Primary Examiner*—Ronald Feldbaum

*Attorney, Agent, or Firm*—McAulay Fishr Nissen & Goldberg

[57] ABSTRACT

The present invention provides a pants-like garment having a stretchable construction. The garment includes a waistband configured to encircle the waist of a wearer and a covering portion configured to encircle the trunk of the wearer. The covering portion has a front section connected, adjacent its top edge, to the waistband and a rear section connected to the front section. A strip of two-way stretchable material having an elasticity in a pair of directions, perpendicular to the waistband and parallel to the waistband, connects the top edge of the rear section of the garment covering portion to the waistband. When the wearer bends over or twists his or her trunk, the strip of elastic material stretches to prevent deformation of the waistband and prevent exposure of the buttocks of the wearer.

5 Claims, 2 Drawing Sheets

PANTS-LIKE GARMENT INCORPORATING A STRETCHABLE CONSTRUCTION

BACKGROUND OF THE INVENTION

1. Field of the Invention

This invention relates generally to a garment configured to encircle the trunk of a wearer, and more particularly, to a pants-like garment incorporating a stretchable construction to prevent exposure of the wearer's buttocks during bending and twisting movements.

2. Description of the Prior Art

Prior art pants-like garments incorporate a waistband configured to encircle the waist of the wearer and a covering portion configured to encircle the trunk of the wearer. The covering portion comprises a front section and a rear section which are both connected, adjacent their top edges, to the waistband. The length of the covering portion may vary depending upon the design of the garment. For instance, if the garment is designed as dress or sport pants, the covering portion has a length sized to fully cover the legs of the wearer. In the case of shorts, the covering portion only partially covers the legs of the wearer.

In order to hold the pants-like garment in position, with the waistband encircling the waist and the covering portion fully covering the trunk of the wearer, the waistband may be provided with a plurality of belt loops to receive a belt that is adjustably fastened to press the waistband inwardly against the waist of the wearer in a binding-like manner. The waistband may be formed from two strip-like portions, namely, a front waistband and a rear waistband contacting the waist of the wearer when the garment is worn.

Even when the pants-like garment is worn with a belt, when the wearer bends over forwardly or twists his or her trunk from side to side, a downward deformation of the rear section of the covering portion and the waistband may result to produce an untidy appearance as well as an embarrassing exposure of the buttocks.

The present invention is intended to prevent such downward deformation of the waistband and the rear section of the covering portion by connecting the rear section to the waistband by a stretchable member. The member preferably includes an elongated strip of stretchable material having an elasticity in a pair of directions perpendicular and parallel to the waistband. When the wearer bends or twists his or her trunk, the material stretches and the waistband remains essentially in an undisturbed position encircling the waist of the wearer. For instance, when the wearer bends forward, the material stretches in a direction perpendicular to the waistband to prevent a downward deformation of the waistband and the rear section of the covering portion and, thereby lessen the likelihood of exposure of the buttocks during such bending movement.

SUMMARY OF THE INVENTION

The pants-like garment of the present invention comprises a waistband configured to encircle the waist of the wearer, and a covering portion configured to encircle the trunk of the wearer. The covering portion has a front section connected, adjacent its top edge, to the waistband, and a rear section connected to the front section. Stretchable means are provided for elastically connecting the rear section, adjacent its top edge, to the waistband. The stretchable means have an elasticity in at least one direction, substantially perpendicular to the waistband, so that when the wearer bends over, the elastic means stretch to prevent downward deformation of the garment at the waistband. As a result, exposure of the buttocks of the wearer is prevented by the stretching of the stretchable means.

In a preferred embodiment, the stretchable means further has an elasticity in another direction substantially perpendicular to the one direction and parallel to the waistband. The purpose of this additional elasticity is to also prevent deformation of the waistband during twisting movements of the trunk of the wearer.

Additional features and advantages of the present invention will become more apparent from a consideration of the following detailed description when taken in conjunction with the accompanying drawings.

DESCRIPTION OF THE PREFERRED EMBODIMENT

Figure 1:
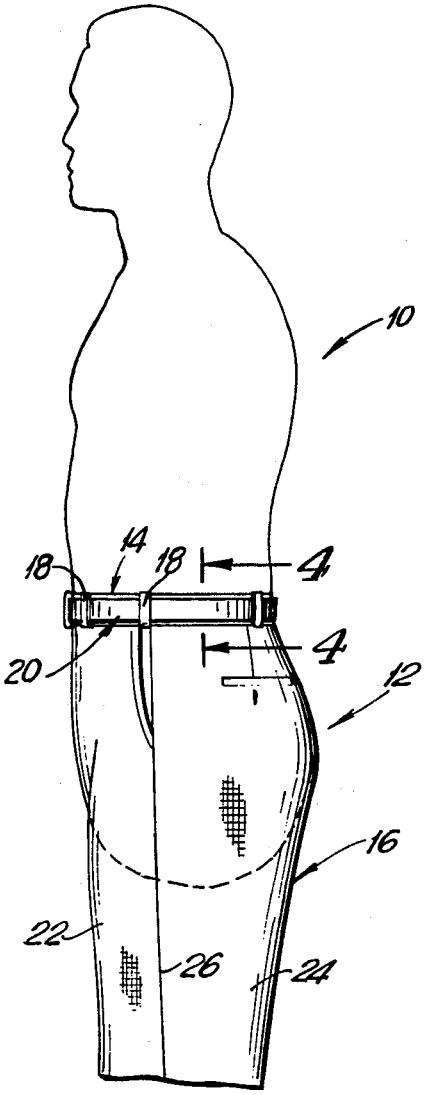
FIG. 1 is a fragmentary, elevational view of a pants-like garment constructed in accordance with the present invention worn by a wearer in an upright, relaxed position.

Referring to FIG. 1, numeral 10 represents a wearer clothed in a pants-like garment 12 fabricated in accordance with the present invention. Garment 12 includes a waistband 14 configured to encircle the waist of the wearer 10 and a covering portion 16 configured to encircle the trunk of wearer 10. Waistband 14 has a plurality of belt loops 18 to receive a belt 20 encircling waistband 14 for holding garment 12 in position. Covering portion 16 has a front section 22 connected adjacent its top edge to waistband 14 and a rear section 24 connected to front section 22. The connection between front and rear sections 22 and 24 is accomplished by means of side seams and inseams of which a side seam, designated by numeral 26, is illustrated for exemplary purposes. Covering portion 16 may be sized to either fully or partially cover the legs of wearer 10.

Figure 3:
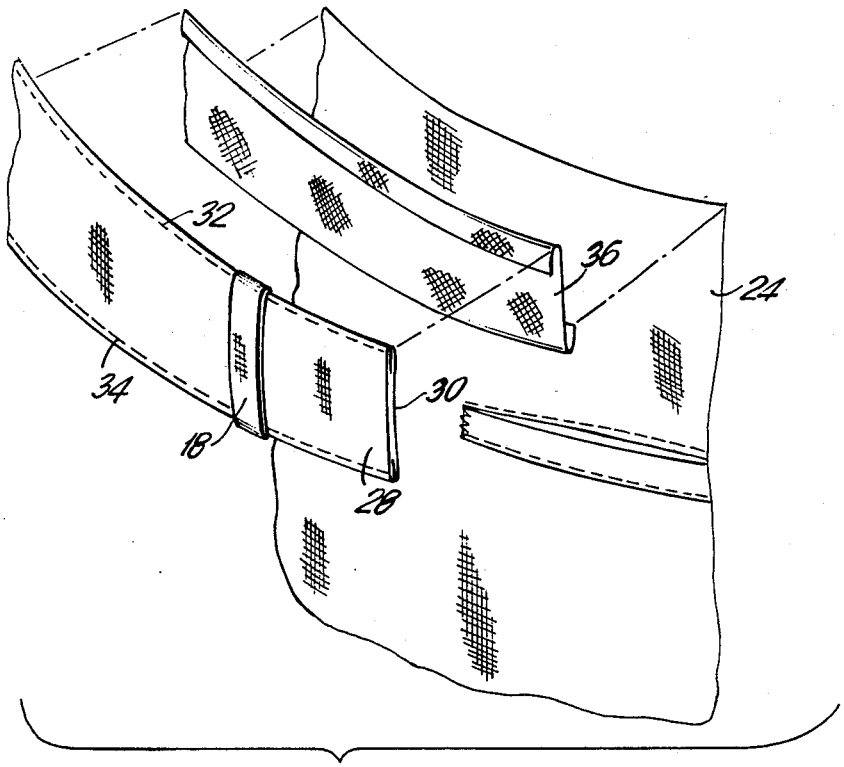
FIG. 3 is an enlarged fragmentary, expoded perspective view of the pants-like garment of FIG. 1 in the region where the waistband is connected to the covering portion of the garment.
Figure 4:
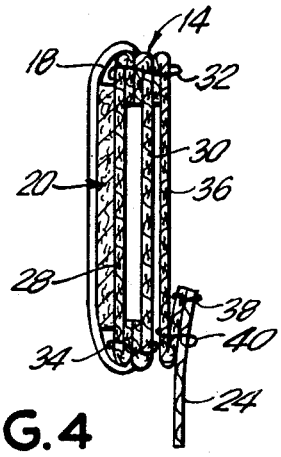
FIG. 4 is an enlarged cross-sectional view taken along line 4—4 of FIG. 1.

Referring to FIGS. 3 and 4, waistband 14 comprises a front panel 28 and a rear panel 30 each having top and bottom edges folded inwardly and secured in a conventional manner by stitch lines 32 and 34, respectively, with the ends of the belt loops 18 sandwiched therebetween. That is, the ends of each belt loop 18 pass between the inwardly folded top and bottom edges of front and rear waistband panels 28 and 30, and are held in place by stitch lines 32 and 34. Although not illustrated, the top edge of front section 22 of garment 12 also is located between the inwardly folded bottom edges of front and rear waistband panels 28 and 30, and is secured in place by stitch line 34.

Rear section 24 of garment 12 is connected, along its top edge, to the waistband 14 by means of an elongated strip of stretch material 36 having a length substantially equal to the length of the top edge of rear section 24. Strip 36 is connected along its top edge to the top edge of the waistband 14 by stitch line 32. That is, the top edge of strip 36 is folded on itself and overlies the outer surface of rear waistband panel 30, whereupon it is secured in place by stitch line 32. Alternatively, the top edge of strip 36 could be sandwiched between the top edges of front and rear waistband panels 28 and 30. The bottom edge of strip 36 is folded outwardly on itself and is connected to the top edge of rear section 24 of garment 12 by stitch lines 38 and 40.

Figure 2:
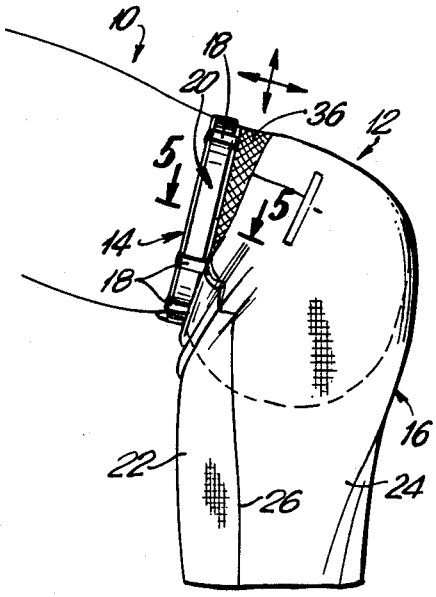
FIG. 2 is a fragmentary, elevational view of the pants-like garment of FIG. 1 in which the wearer is in a bent over position.
Figure 5:
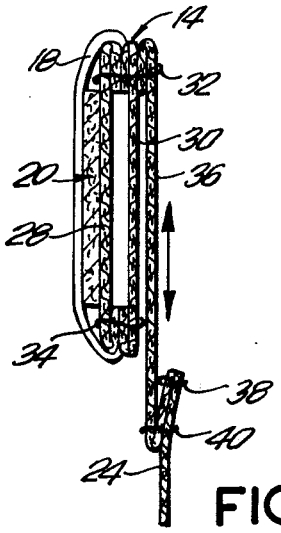
FIG. 5 is an enlarged cross-sectional view taken along line 5—5 of FIG. 2.

The construction is such that when garment 12 is worn, strip 36 is located against the waist of wearer 10 and is covered by waistband 30 which, for aesthetic reasons, thereby, hides strip 36 from view when the wearer is in the upright, relaxed position illustrated in FIG. 1. However, when wearer 10 bends forwardly over, strip 36 stretches downwardly below the waistband as shown in FIGS. 2 and 5, against the elasticity of the strip material. Although the lower portion of strip 36 is no longer hidden by waistband 14, the waistband remains in an undisturbed position encircling the waist of wearer 10 as a result of the stretchability of strip 36. Thus, the buttocks of wearer 10 remain fully covered by covering portion 16 and strip 36. When wearer 10 reassumes an upright position, elastic strip 36 reverts back to its initial relaxed position covered by waistband 14.

Strip 36 preferably is fabricated from a two-way stretch material that has elasticity in a direction perpendicular to waistband 14; that is, in another direction parallel to waistband 14. This is represented by the double headed arrows in FIG. 2. Thus, if the wearer 10 were to twist his or her trunk from side to side, strip 36 would, again, stretch to leave waistband 14 in an undisturbed or non-displaced position encircling the wearer's waist.

Strip 36 preferably is fabricated from a woven material comprising Spandex and nylon, or Lycra and nylon. Additionally, strip 36 could be formed from tricot, or rubber. Strip 36 also could be formed of a texturized nylon or polyester or synthetic fabric in which the yarn has been crimped causing an elasticized action.

Strip 36 has a width that is substantially equal to the width of waistband 14 so that it is hidden from view when the garment 12 is worn by the wearer 10 in an upright, relaxed position. Strip 36 could be formed having a width greater than that of waistband 14 but this would be undesirable, for aesthetic reasons, in that the lower portion of strip 36 would then be exposed even when wearer 10 was in an upright, relaxed position.

While a preferred embodiment of the invention has been shown and described in detail, it will be readily understood and appreciated that numerous omissions, changes and additions may be made without departing from the spirit and scope of the present invention.

I claim:

1. A pants-like garment comprising:

a waistband configured to encircle the waist of a wearer; and a covering portion confirgured to encircle the trunk of the wearer;

said covering portion having a front section connected adjacent its top edge to said waistband, and a rear section connected to said front section; and stretchable means for elastically connecting said rear section, adjacent its top edge, to said waistband;

said stretchable means having an elasticity in at least one direction, substantially perpendicular to said waistband, so that when the wearer bends over, said elastic means stretch to prevent downward deformation of said garment and said waistband thereby to prevent exposure of the buttocks of the wearer.

2. The garment of claim 1, wherein said stretchable means comprises an elongated strip of stretch material connected, adjacent its lengthwise edges, to the top edge of said rear section and the top edge of said waistband, respectively.

3. The garment of claim 2, wherein said waistband covers said strip of stretch material so that said stretch material remains hidden from view by said waistband when said wearer is in an upright, relaxed position.

4. The garment of claim 2, wherein said stretch material has two-way stretchability to provide elasticity in another direction, substantially perpendicular to said one direction and parallel to said waistband, to also prevent deformation of said waistband during twisting movements of the trunk of the wearer.

5. The garment of claim 3, wherein said stretch material has two-way stretchability to provide elasticity in another direction, substantially perpendicular to said one direction and parallel to said waistband, to also prevent deformation of said waistband during twisting movements of the trunk of the wearer.

* * * * *